US007954427B2

(12) United States Patent
Ishikawa et al.

(10) Patent No.: US 7,954,427 B2
(45) Date of Patent: Jun. 7, 2011

(54) ROTARY STAMP WITH MASTER STAMP

(75) Inventors: Hirotoshi Ishikawa, Gifu (JP); Hirofumi Kondo, Oobu (JP); Shogo Ichise, Aichi (JP); Takahiro Higuchi, Ichinomiya (JP); Taketoshi Ota, Nagoya (JP)

(73) Assignee: Shachihata Inc., Nagoya-Shi (JP)

( * ) Notice: Subject to any disclaimer, the term of this patent is extended or adjusted under 35 U.S.C. 154(b) by 556 days.

(21) Appl. No.: 12/054,649

(22) Filed: Mar. 25, 2008

(65) Prior Publication Data

US 2008/0236415 A1 Oct. 2, 2008

(30) Foreign Application Priority Data

Mar. 27, 2007 (JP) ..... 2007-081973
Feb. 26, 2008 (JP) ..... 2008-044753

(51) Int. Cl.
*B41J 1/60* (2006.01)

(52) U.S. Cl. ..... 101/111; 101/105

(58) Field of Classification Search ..... 101/105, 101/111, 104, 108, 327, 328, 405, 406
See application file for complete search history.

(56) References Cited

U.S. PATENT DOCUMENTS 2,975,702 A * 3/1961 Hutzelman ..... 101/99
3,476,657 A * 11/1969 Lundquist ..... 205/69
3,977,321 A * 8/1976 Pabodie ..... 101/111
4,006,680 A * 2/1977 Grace et al. ..... 101/93.14
4,038,918 A * 8/1977 Funahashi ..... 101/111
4,090,442 A * 5/1978 Yazawa et al. ..... 101/111
4,119,030 A * 10/1978 Funahashi ..... 101/111
4,561,353 A * 12/1985 Chapman et al. ..... 101/111
4,858,526 A * 8/1989 Bengtsson ..... 101/111
6,634,288 B1 * 10/2003 Imamaki et al. ..... 101/125
2006/0201354 A1 9/2006 Suda

FOREIGN PATENT DOCUMENTS

CN 1097689 A1 1/1995
CN 1856406 A1 11/2006
JP 06-286283 A1 10/1994
JP 07-009656 Y2 3/1995
JP 2000-272215 A1 10/2000

* cited by examiner

*Primary Examiner* — Ren Yan
(74) *Attorney, Agent, or Firm* — Burr & Brown

(57) ABSTRACT

In a rotary stamp with master stamp incorporating a master stamp having an oblong hole from which a desired print section of a rotary stamp is exposed in the bottom part of a grip case containing the rotary stamp, a thin melt-processed laminated belt produced by treating the superficial layer of a laminated belt foundation composed of porous thermoplastic resin belt base and an ink circulation reinforced rear fabric such that only a print section is left in a porous state while the other part of the belt is melt processed into anon-porous state that is used as an endless print belt, with the oblong hole in the master stamp formed in a size which allows the belt to pass along a bridge part without the surfaces making contact therewith.

11 Claims, 15 Drawing Sheets

ROTARY STAMP WITH MASTER STAMP

BACKGROUND OF THE INVENTION

1. Field of the Invention

The present invention relates to a rotary stamp with master print, the rotary stamp having an endless print belt and the master print incorporated in a grip case and having porous fixed print base including a window hole from which a given print section of the endless print belt of the rotary stamp is exposed.

2. Description of the Related Art

There has been widely known a rotary stamp with a master stamp, a rotary stamp having endless print belts and the master stamp having a porous fixed print base including a window hole from which a desired print section of the rotary stamp is exposed being incorporated in a grip case, so as to print date, department name, personal name and the like at the same time (for example, Patent Document 1 and Patent Document 2).

However, when the print section of the rotary stamp is changed, the rotary stamp with the master stamp described in the Patent Documents 1 and 2 cannot change the print section unless the rotary stamp is lifted up so as to retract the print section from the window hole in the master print and each belt print of the rotary stamp is rotated by operating a rotator, which poses a problem that increases the number of operations when changing its stamp face. To eliminate such a problem, it can be considered to enlarge the window hole in the master stamp so as to enable changing of the print section of the rotary stamp to be exposed through the window hole to be carried out freely only by rotating operation of the rotator. However, if the window hole is increased, it creates such problems that the print face and non-print area of the master stamp are decreased and further, the bottom of the belt stamp applied to the bridge part is shifted to the center and inclined by the amount of the rotator, and thus, a distortion is generated in the print face thereby making a print image unclear.

Patent document 1: Japanese Examined Utility Model 1995-9695

Patent document 2: Japanese Published Patent Application 2000-272215

SUMMARY OF THE INVENTION

Accordingly, an object of the present invention is to solve the aforementioned problems in the rotary stamp with master stamp incorporated in a grip case constituted of the rotary stamp having the endless print belt and the master print having the porous fixed print base containing a window hole which exposes the print section of the endless print belt of the rotary stamp and provide a rotary stamp with master stamp capable of changing the print face freely by only a rotating operation of a rotator exposed out from a grip case without pulling up the rotary stamp, accompanied by no reduction of effective usage area of the master stamp.

To achieve the above-described object, the present invention provides a rotary stamp with master stamp comprising: a rotary stamp in which an endless print belt is stretched between a shaft part of a rotator supported rotatably by a shaft provided on a rotary stamp frame and a bridge part provided on the rotary stamp frame; and a master stamp having a porous fixed print base containing an oblong hole which exposes a desired print section of the rotary stamp, the rotary stamp and the master stamp being built in a grip case, wherein the endless print belt of the rotary stamp is a thin melt-processed laminated belt constituted of a print section kept in porous state and a space part treated into non-porous state, the print section and the space part being created as a result of melt-processing the superficial layer of the laminated belt base composed of the thermoplastic resin belt foundation having an infinite number of continuous pores as a front layer and ink circulation reinforced rear fabric as a rear layer, and the oblong hole in the master stamp has a width in the longitudinal direction which allows the endless print belt to be rotated such that the belt surface does not make contact with hole edges in the front and back when the belt is rotated along the bridge part with a print section exposed through the oblong hole, and changing of the print section of the rotary stamp exposed through the oval window is enabled by only a rotating operation of a rotator exposed outside of a grip case.

In the rotary stamp with master stamp of the present invention, the rotary stamp built in the grip case is pushed by a spring member so that a desired print section of the endless print belt always exposed through the oblong hole is projected slightly from the master stamp surface of the master stamp and when the stamp is pressed, primary stamping by the print face of the rotary stamp is carried while the rotary stamp is pushed up against the force of the spring member such that the print face of the rotary stamp is flush with the master stamp surface, so as to execute secondary stamping by the master print surface.

A groove in width direction is formed in the space parts formed in the non-porous state between the print sections of the endless print belt. Preferably, the groove has enclosing bund parts on both ends. Pyramidal projections for engaging the endless print belt are disposed on the outer peripheral face of a shaft part of the rotator in a staggered fashion or a control plate made of synthetic resin for smoothing a rotation of the rotator that is built on a shaft stretched in the rotary stamp frame along the inner side of the rotator. Further, preferably, notch part is formed in the outer peripheral face of the rotation operating part of the rotator.

Preferably, the notch part is formed in the outer peripheral face of the rotation operating part of the rotator and further, a clicker is built in a rotary stamp frame, such that the top face thereof is pushed by a spring member, with an engagement spring piece of a leg end engaged with an engagement hole provided in the top part of a rotary stamp frame, and the clicker is provided with a rectangular frame-like engagement spring piece which is always engaged with a notch part of a rotator, accordingly, when the rotator is rotated, the engagement spring piece engages a dent in the notch part so as to produce unique operating sound.

As the endless print belt of the rotary stamp of the present invention, the superficial layer of the laminated belt base constituted of the thermoplastic resin belt foundation having an infinite number of continuous pores as a front layer and ink circulation reinforced rear fabric as a rear layer is formed to the print section left in porous state and a surrounding part melt-processed to non-porous face so as to produce a thin melt-processed laminated belt having thin print face. Further, the oblong hole in the master stamp is of minimum size which allows the endless print belt to be rotated along the bridge part such that the print section is exposed through the oblong hole without making contact with the hole edges in the front and back. Thus, changing of the print section of the rotary stamp exposed through the oblong hole can be implemented freely by only rotating operation of the rotator, exposed out from the grip case without pulling up the rotator and reducing the effective usage area of the master stamp.

Further, the bottom part of the endless print belt wound up around the bridge part is shifted toward the center and inclined by only an amount corresponding to the thickness of the rotator. Due to the small thickness of the print face, the print face of the endless print belt becomes substantially horizontal following the shape of the bridge part, and thus, a print image having no distortion can be obtained.

The rotary stamp incorporated in the grip case is pushed by a spring member such that a desired print section of the endless print belt exposed from the window hole is projected slightly from the master print face of the master stamp. As a result, upon a stamping operation, first, primary stamping is carried out with this projected print section of the rotary print and the rotary print is pushed up against a spring force of the spring member so that the print face and the master print face are flush with each other so as to execute the secondary stamping with the master print face. As a result, at the time of the primary stamping, the print face of the endless print belt is always disposed horizontal with respect to a stamping object surface and thus, appropriate stamping is carried out despite the small print face thickness, so as to obtain a clear print image.

If the groove is formed in the width direction in the non-porous space part between the print sections of the endless print belt, when the operation for changing the print face of the porous thin belt stamp is carried out and the part containing the formed print section passes the bridge part of the rotary stamp frame, the groove in the rear face is located on the corner of the bridge part whereby the operating resistance changes. Because the user can obtain a feeling that the operation resistance has been changed, the user does not need to confirm the change of the print face visually. Further, the groove is used as criterion for arranging the print sections of the endless print belt as shown in FIG. 4A. In the meantime, this groove may be formed such that it communicates throughout in the width direction or such that both ends are left with material (for example, about 0.5 to 1.0 mm) as shown in FIG. 4B in order to prevent ink from running out.

DETAILED DESCRIPTION OF THE INVENTION

Hereinafter the preferred embodiments of the present invention will be described in detail with reference to the accompanying drawings.

Figure 1:
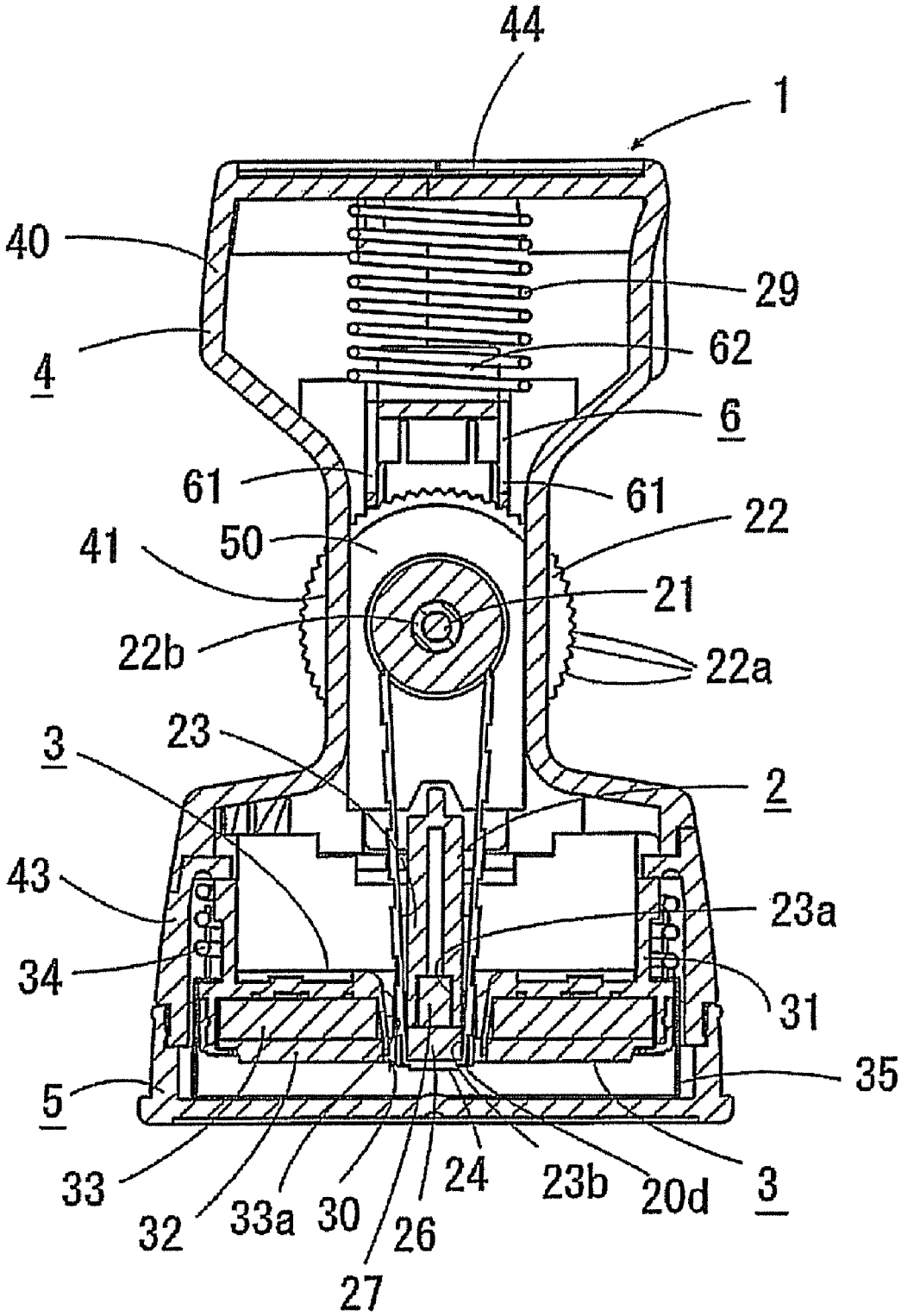
FIG. 1 is a side sectional view showing a preferred embodiment of the present invention.

Referring to FIG. 1, reference numeral 1 denotes a rotary stamp main body with a master stamp. This rotary stamp main body 1 incorporates a rotary stamp 2 inside of a grip case 4 and a master stamp 3 is built in the bottom part of the grip case 4. The rotary stamp main body with the master stamp 1 can be mounted on a desk through a print face cap 5 for print face protection, which is fitted to the bottom end. This character is the same as this kind of the rotary stamp with the master stamp.

The rotary stamp 2 includes an endless print belt 24 stretched between a plurality of rotators 22 supported rotatably by a shaft 21 provided in the middle of a rotary stamp frame 20 and a bridge part 23 provided on the bottom end of the rotary stamp frame 20. This basic structure is not different from a conventionally known one and many are used without being incorporated in a grip case 4.

Figure 7:
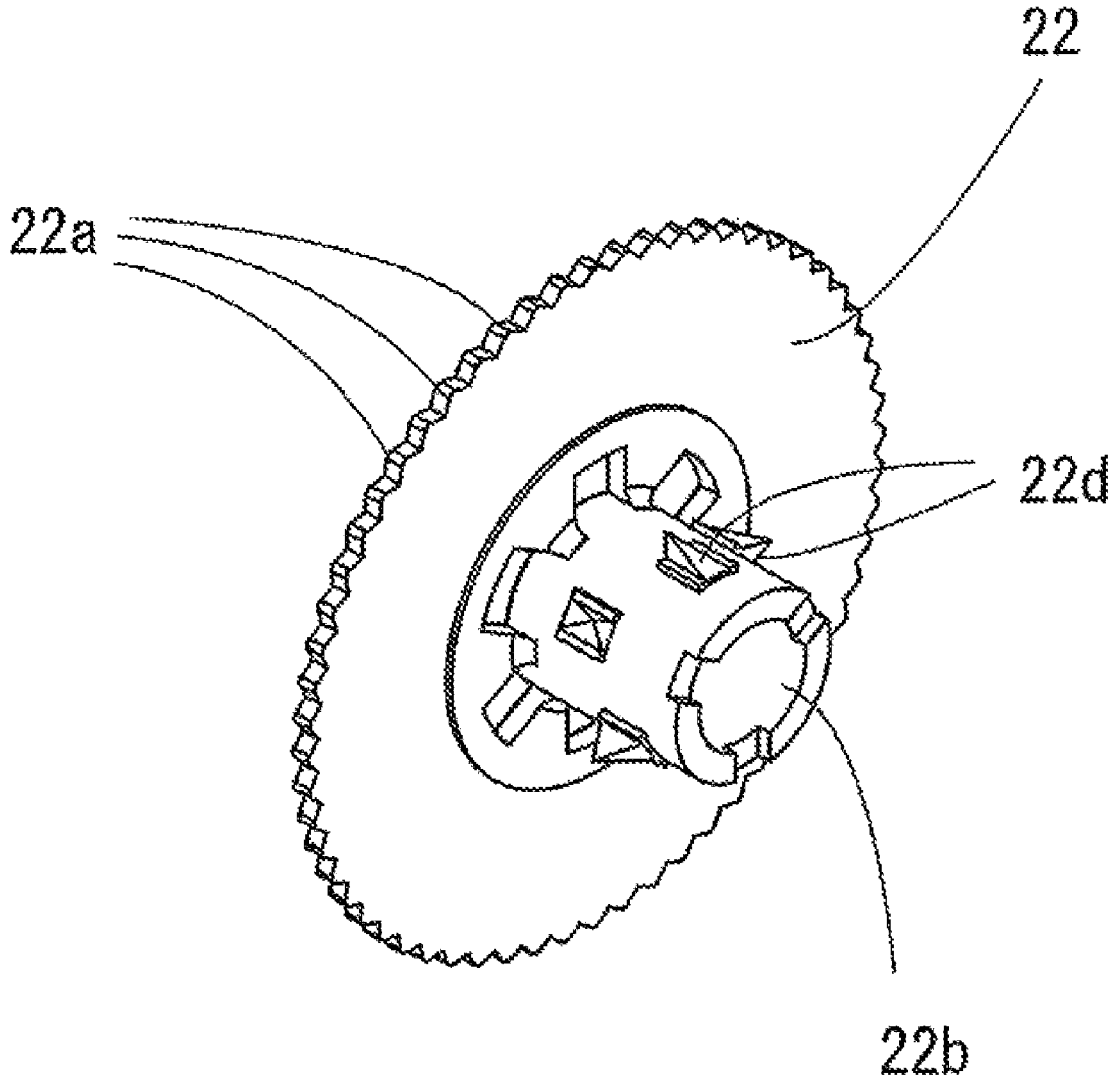
FIG. 7 is a perspective view of a rotator (wide) for use in the present invention.
Figure 8:
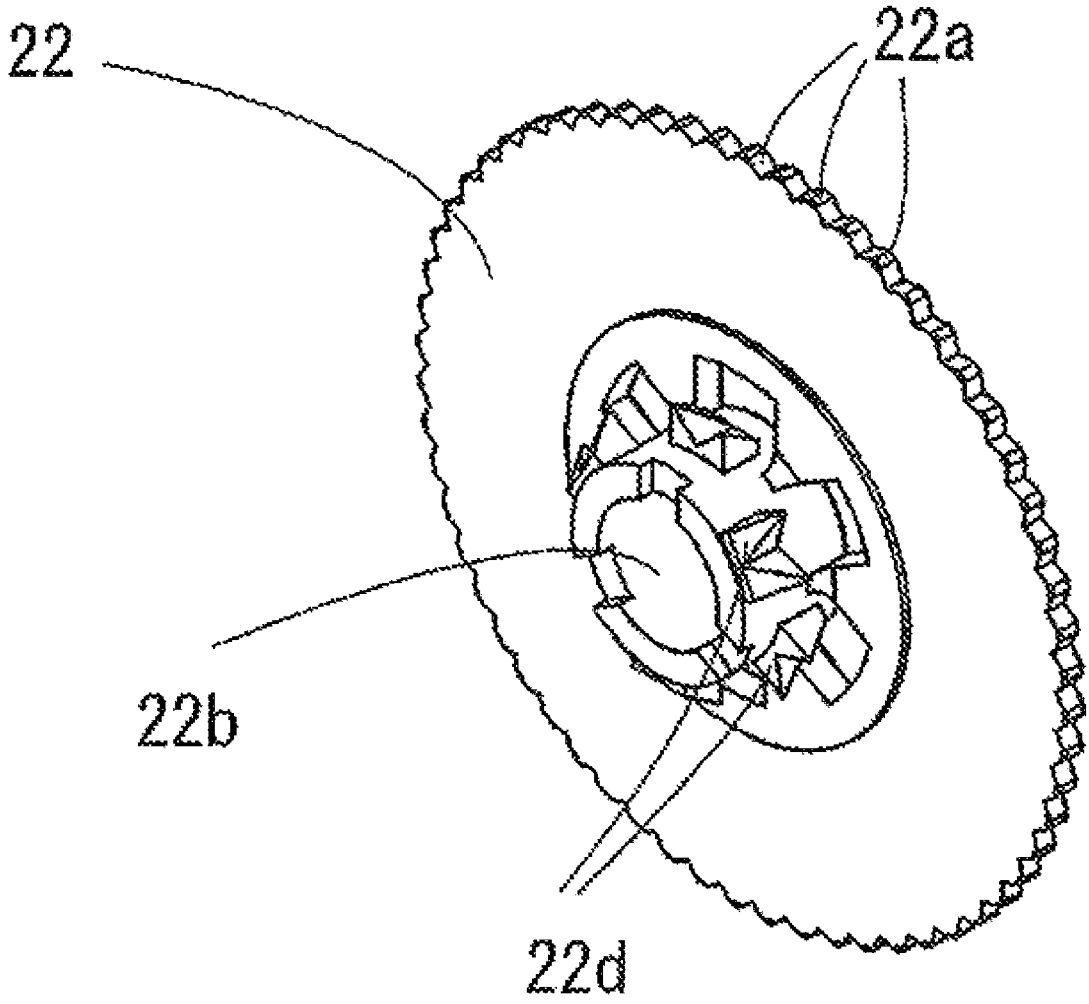
FIG. 8 is a perspective view of a rotator (narrow) for use in the present invention.

As the endless print belt 24 used in this rotary stamp 2, a laminated belt comprised of thermoplastic resin belt foundation 24*a* having an infinite number of continuous pores such as foamed polyethylene resin provided on its superficial layer and ink circulating reinforced rear fabric 24*b* provided on the rear face, is used. By melting the superficial layer of this laminated belt foundation, the print section is left in a porous state and the remaining surrounding part is melted to be a non-porous face, in order to obtain thin laminated belt subjected to such melting treatment, having a thickness of less than 2.0 mm. As shown in FIGS. 7 and 8, the aforementioned rotators 22 include a rotator for wide endless print belt and a rotator for narrow endless print belt.

Figure 9:
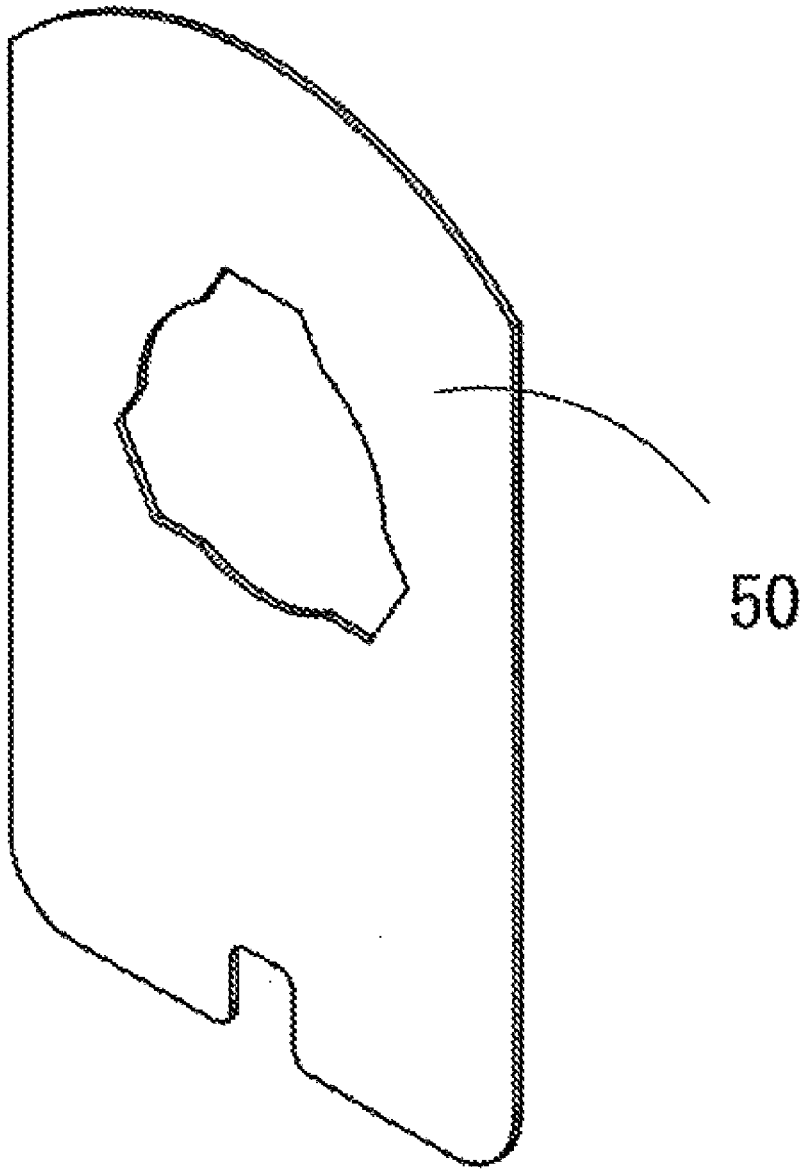
FIG. 9 is a perspective view of a control plate for use in the present invention.
Figure 10:
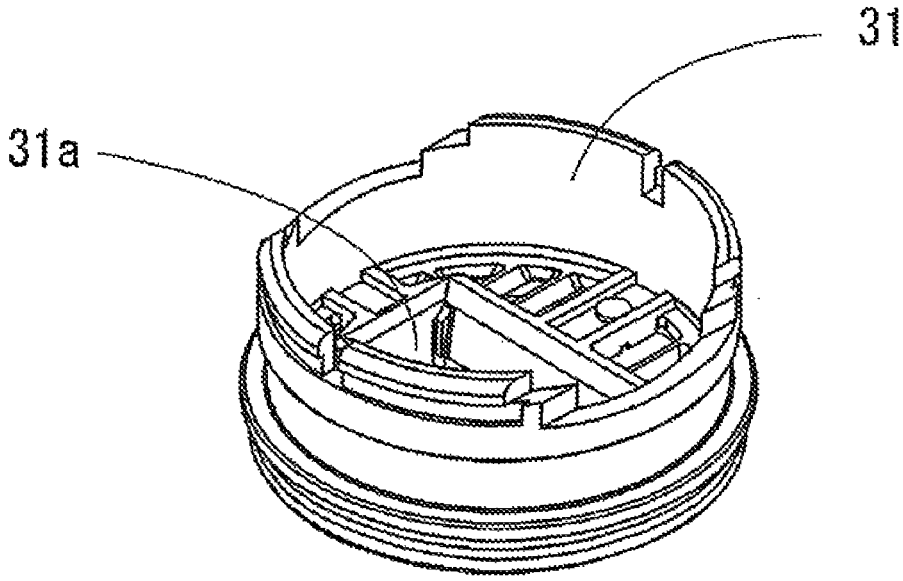
FIG. 10 is a perspective view of a master stamp frame for use in the present invention.

To rotate the endless print belt 24 smoothly, a substantially rectangular control plate 50 made of polyethylene resin as shown in FIG. 9 is incorporated on the inner side of the opposing rotators 22 in the middle. The rotary stamp 2 is incorporated within the grip case 4 such that the top part of the rotary stamp frame 20 is always pressed downward by a spring member 29 such as coil spring and when a pressing force exceeding the urging of the spring member 29 is applied, the rotary stamp 2 is raised.

Reference numeral 22*a* denotes a notch part formed on the outer peripheral face of a rotation operating part of each rotator 22 and this notch part 22*a* prevents the finger from slipping upon rotating operation and engages an engagement spring piece 60 of a clicker 6 described later. Reference numeral 22*b* denotes an axial cylindrical part on which the endless print belt 24 is applied and pyramidal projections 22*d* which engage the endless print belt 24 are disposed on the outer peripheral face of this axial cylindrical part 22*b* in a staggered fashion.

Figure 4A:
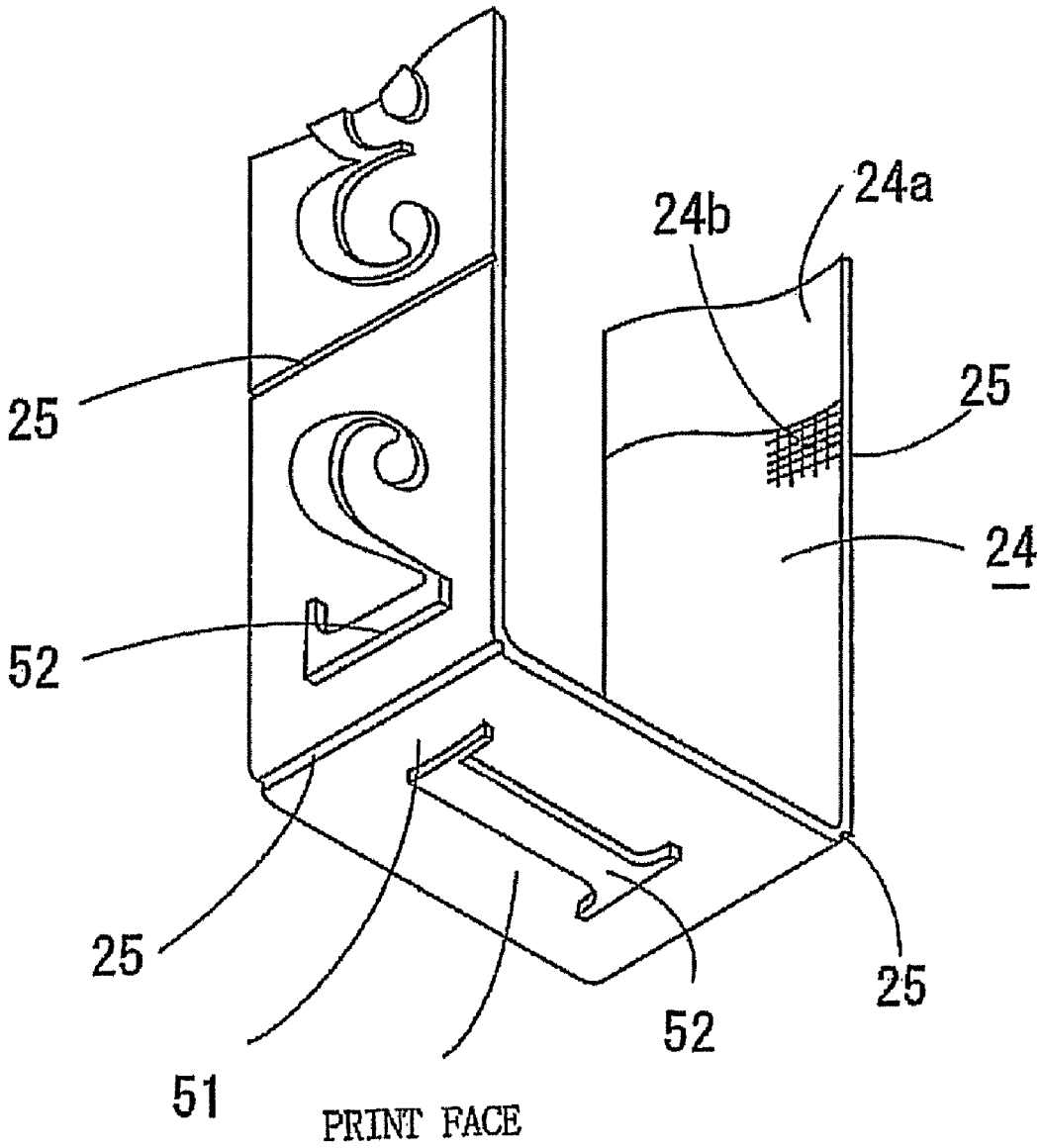
FIG. 4A is a partially broken perspective view showing the endless print belt for use in the present invention in enlargement.
Figure 4B:
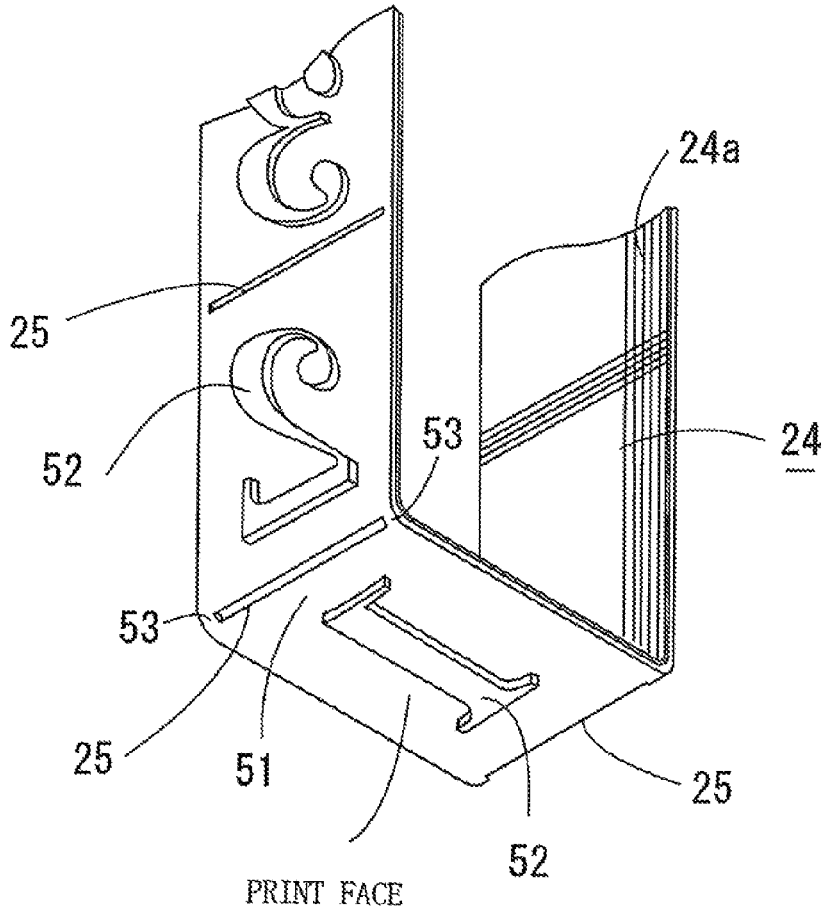
FIG. 4B is a partially broken perspective view showing another example of the endless print belt for use in the present invention in enlargement.

Further, as shown in FIG. 4A and FIG. 4B, a groove 25 continuous in the width direction is formed between print sections A and A of the endless print belt 24. When the endless print belt 24 is rotated to change its print face, the grooves 25 are positioned on the corners of the bridge part 23, so that it can be felt that the print face has been changed without confirming visually but based on a feeling that the operation resistance has been changed. Thus, it is not necessary to confirm the print face visually each time when the rotating operation is performed.

Figure 4C:
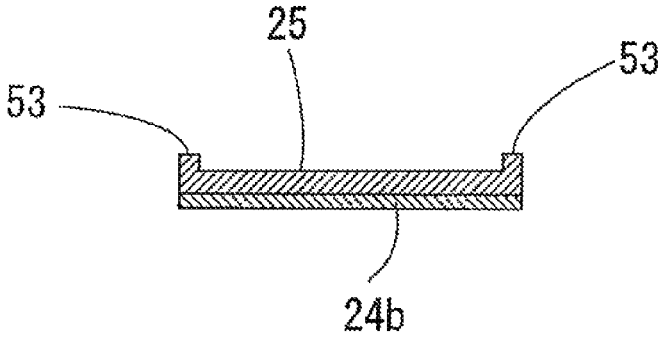
FIG. 4C is a sectional view of FIG. 4B.

The groove 25 is formed at a middle position for dividing a space part 51 of the endless print belt 24 to two sections between print sections 52 and 52 and as described previously, this groove 25 may be a groove communicating with both ends of the endless print belt 24 as shown in FIG. 4A or as shown in FIG. 4C, enclosing bund parts 53 and 53 may be left on both ends of the groove 25 to prevent ink from running out. If the enclosing bund part 53 and 53 are provided, the length of the enclosing bund part 53 is as short as 0.5 to 1.0 mm and the height of the enclosing bund part 53 is such that its top is substantially on the same plane as the surface of the space part 51. By providing with the grooves 25, when the print belt main body 24 is rotated to change the print face, the grooves 25 are positioned on the corners of the bridge part 23, so that it can be felt when the print face has been changed without confirming visually based on a feeling that the operation resistance has been changed. As a result, it is not necessary to confirm visually the print face each time when the rotating operation is performed. Further, when the enclosing bund parts 53 and 53 are provided, not only the ink run-out preventing effect which is an inherent function of the enclosing bund part 53 is secured, but also a necessary strength of the belt can be maintained due to the reinforcement effect of the enclosing bund parts 53, 53 even if the grooves 25 are thinned. In the meantime, the grooves 25 and the enclosing bund parts 53, 53 are preferred to be formed into the non-porous state by melting or coating like the space part 51.

Figure 2:
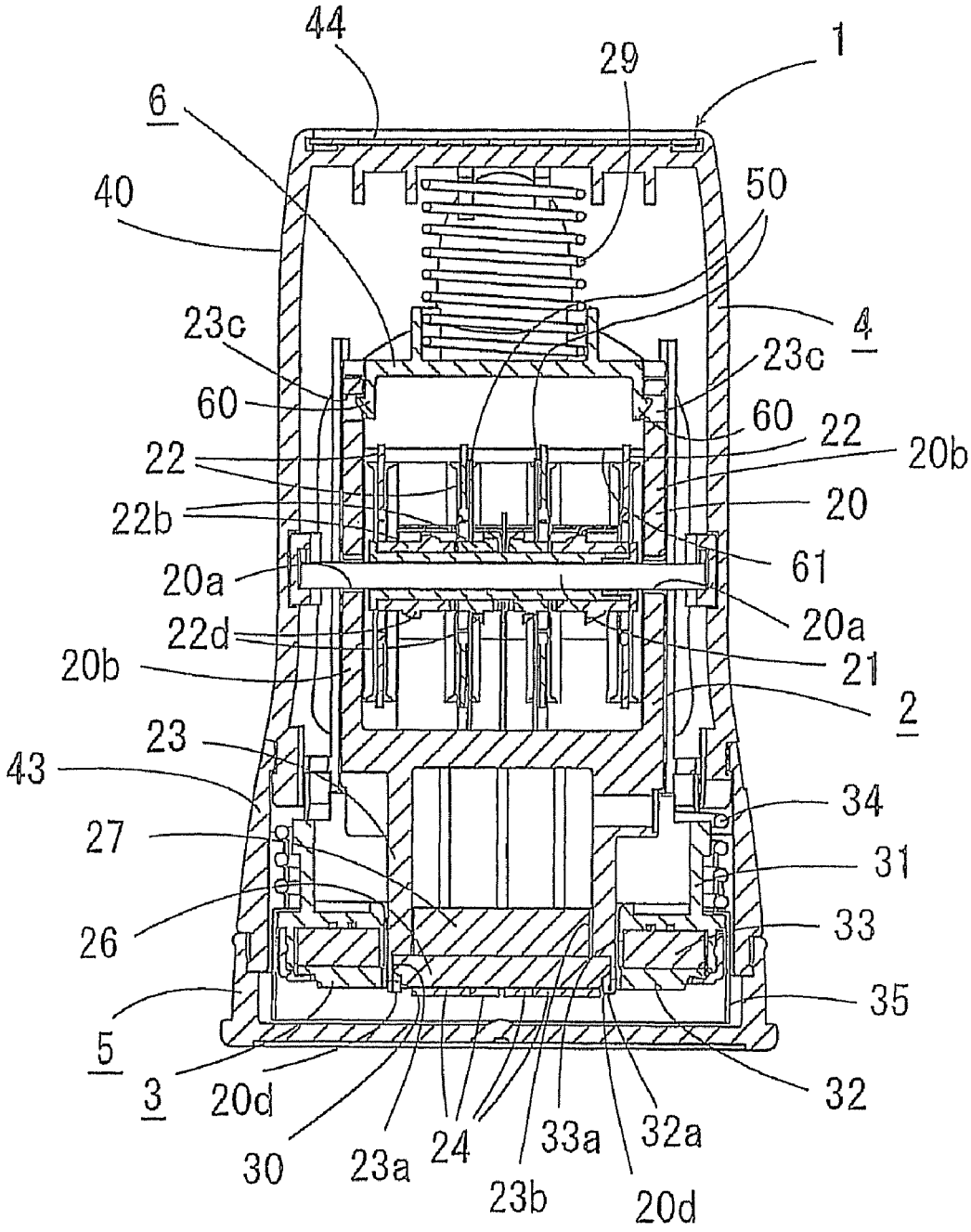
FIG. 2 is a front sectional view stowing a preferred embodiment of the present invention.
Figure 3:
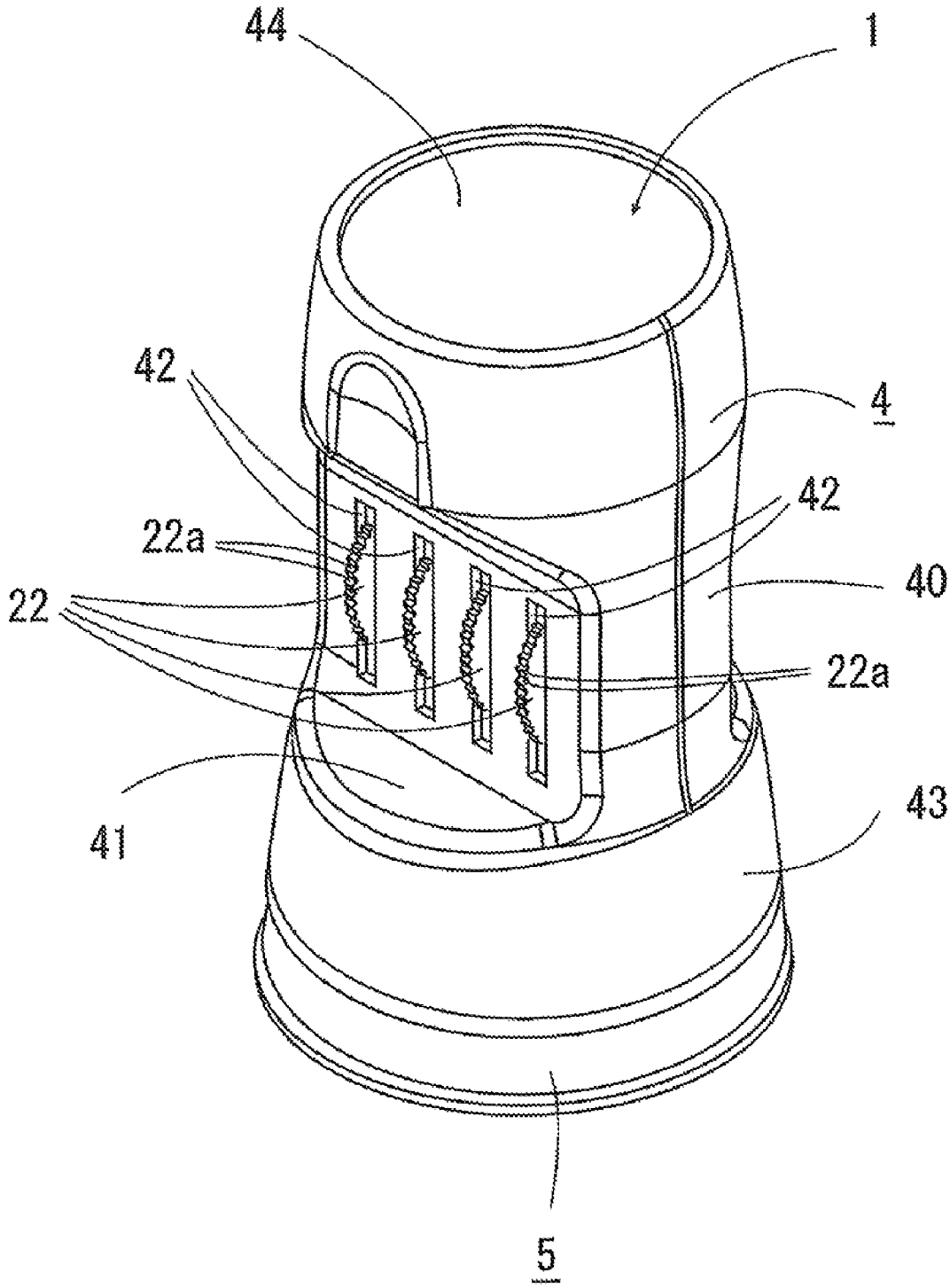
FIG. 3 is a perspective view showing a preferred embodiment of the present invention.

In the endless print belt 24, as shown in FIG. 2, its top part is wound around the rotator 22 and its bottom part is wound around the bridge part 23 such that it keeps contact with an adjoining endless print belt 24. The width of the top part is increased by the amount corresponding to the thickness of the rotator 22, thereby likely causing a distortion in the endless print belt 24. However, the endless print belt 24 of the present invention is a thin melt-processed laminated belt constituted of the print section in which the superficial layer of the laminated belt base composed of the thermoplastic resin belt foundation 24*a* as a front layer and the ink circulation reinforced rear fabric 24*b* as a rear layer that is also in a porous state, along with the melt-processed, non-porous surface which surrounds that print section. Due to its small thickness, it is entirely horizontal following the shape of the bridge part 23 so that a print image is not distorted.

Figure 5:
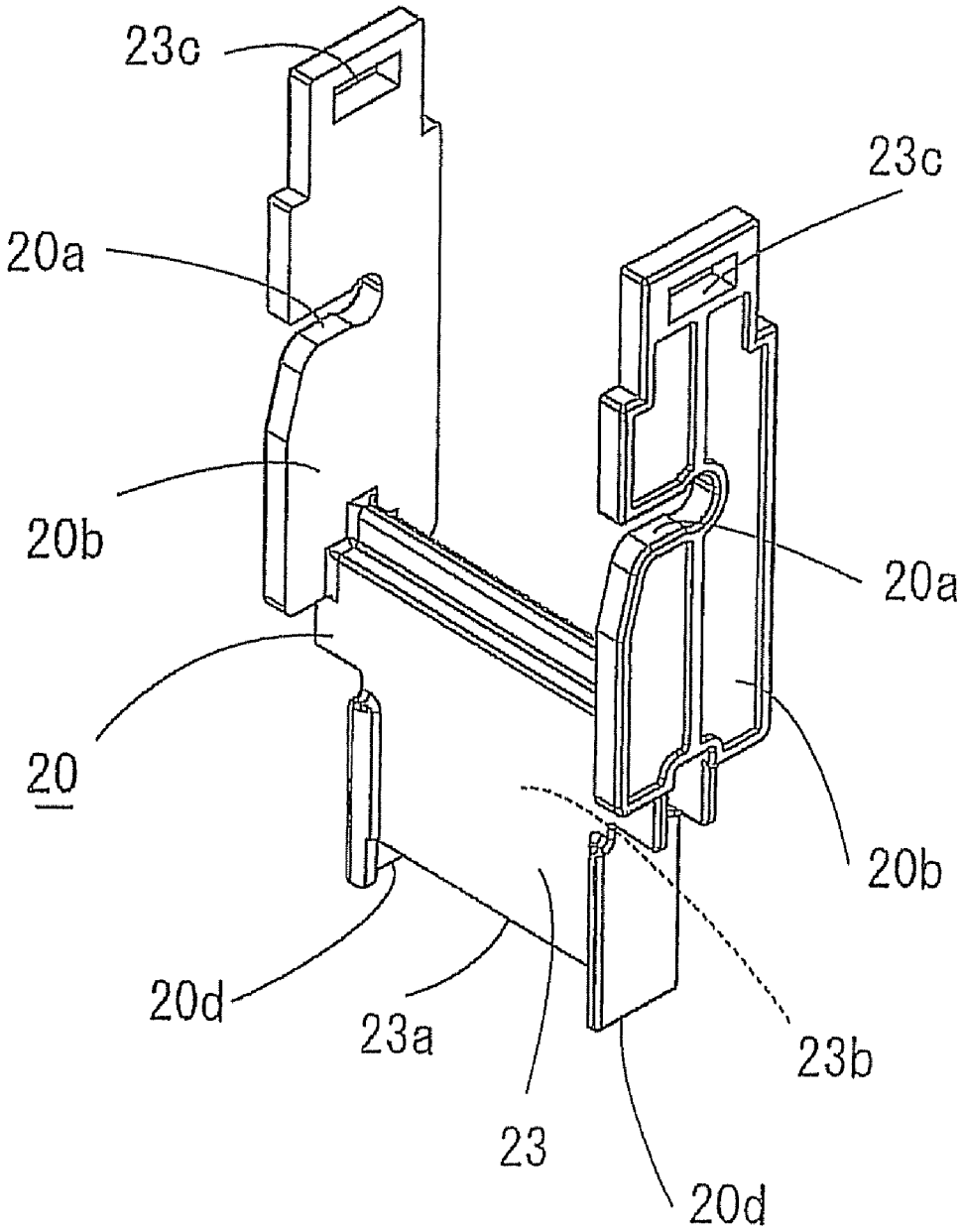
FIG. 5 is a perspective view of a rotary stamp frame for use in the present invention.
Figure 6:
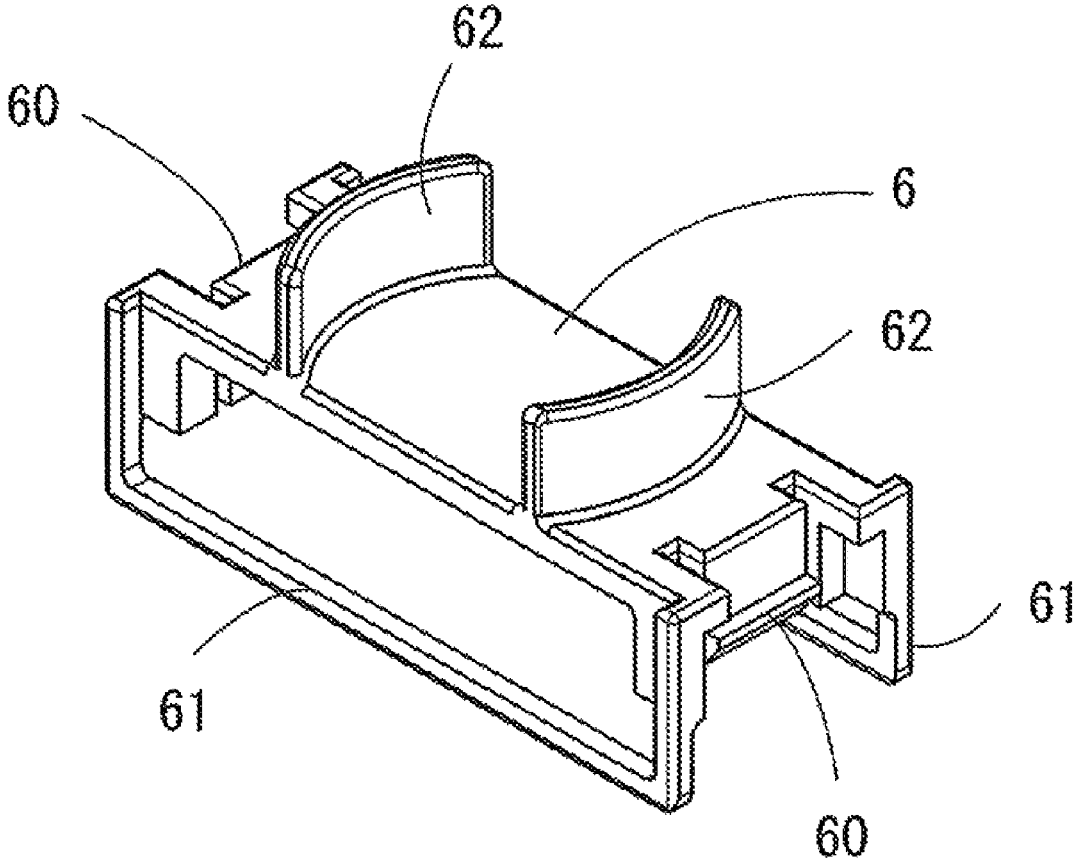
FIG. 6 is a perspective view of a clicker for use in the present invention.

As shown in FIG. 5, in the aforementioned rotary stamp frame 20, the bottom part of both side plates 20*b* each having a cutout part 20*a* for engaging a shaft 21 are connected by a longitudinally long bridge part 23. A groove 23*a* has a first ink absorbing body 26 fitted to and formed along the bottom of the bridge part 23 and a concave part 23*b* having a second ink absorbing body 27 fitted to and formed along the top end. Further, an engaging hole 23*c* for connecting with the clicker is provided in the top part of each side plate 20*b* and the clicker 6 described later is mounted between the engaging holes 23*c* and 23*c* such that both ends thereof engage them. Side plates 20*d* are provided on both sides of the bridge part 23 so as to escort (i.e., guide) the outside of the endless print belt 24.

Accordingly, reference numeral 26 denotes the first ink absorbing body for supplying ink to the endless print belt 24, this ink absorbing body 26 is fitted to the groove 23*a* in the bridge part 23, and is composed of hard porous material such as polyethylene sintered body, which is the same material as the thermoplastic resin belt foundation 24*a* of the endless print belt 24. Reference numeral 27 denotes a second ink absorbing body composed of polyvinyl formal resin which is overlaid on the first ink absorbing body 26 with this second ink absorbing body 27 being fitted to the concave part 23*b* in the bridge part 23.

Figure 11:
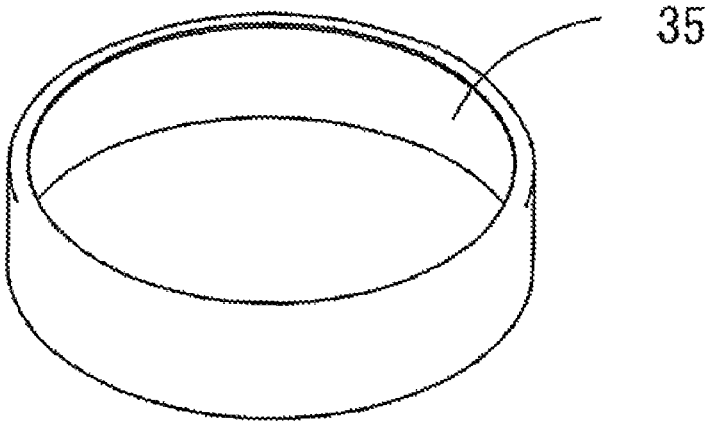
FIG. 11 is a perspective view of a metallic slide for use in the present invention.
Figure 12:
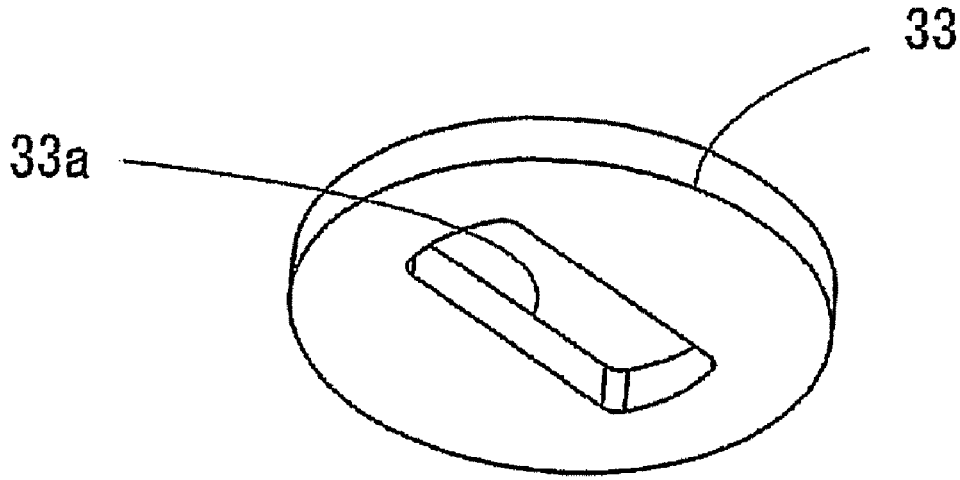
FIG. 12 is a perspective view of an ink-absorbing body of a porous fixed print base for use in the present invention.
Figure 13:
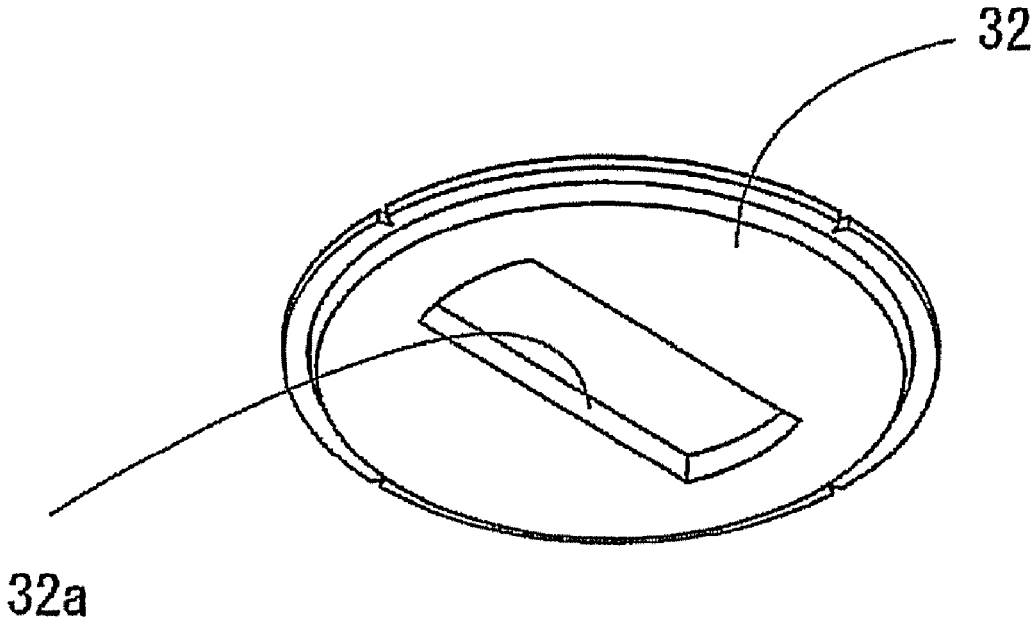
FIG. 13 is a perspective view of a master stamp for use in the present invention.
Figure 14:
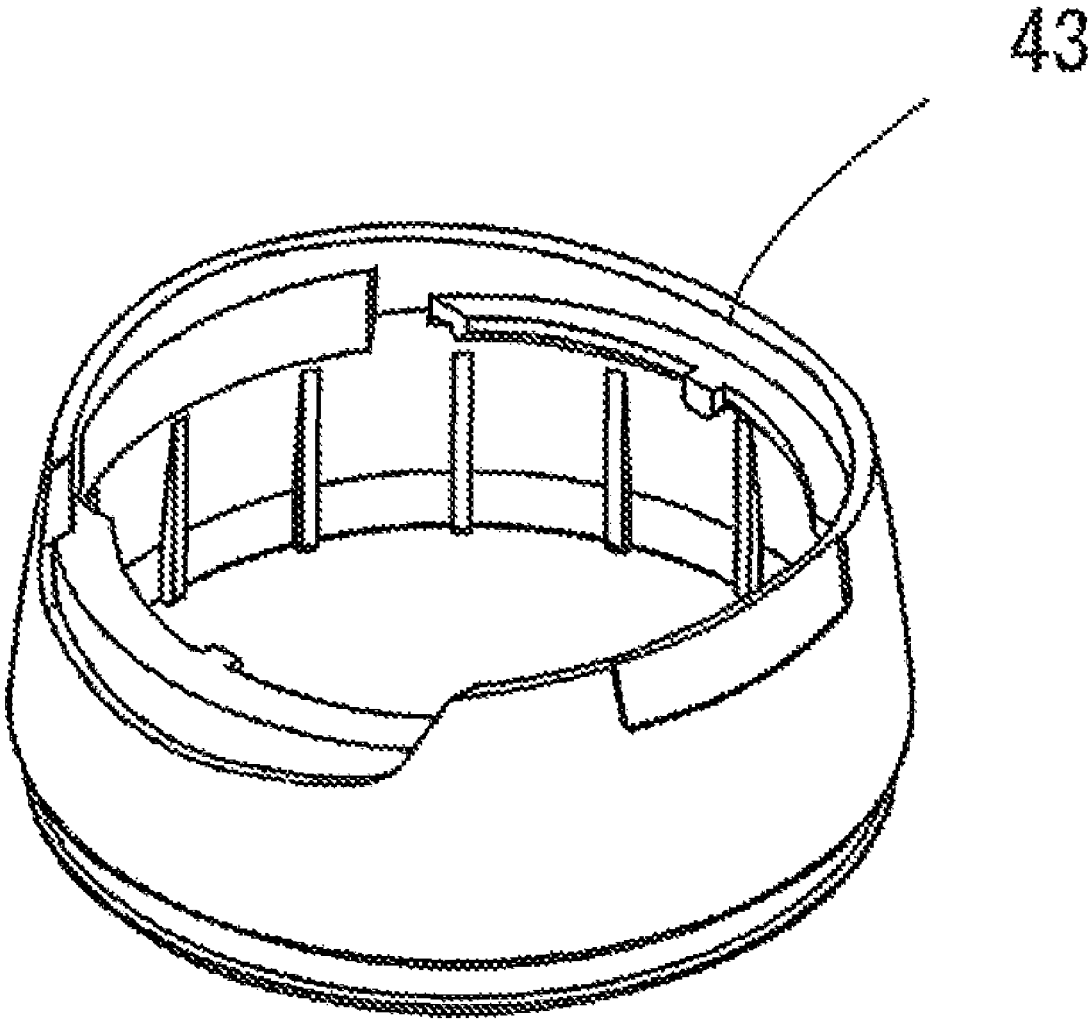
FIG. 14 is a perspective view of a sheath for use in the present invention.
Figure 15:
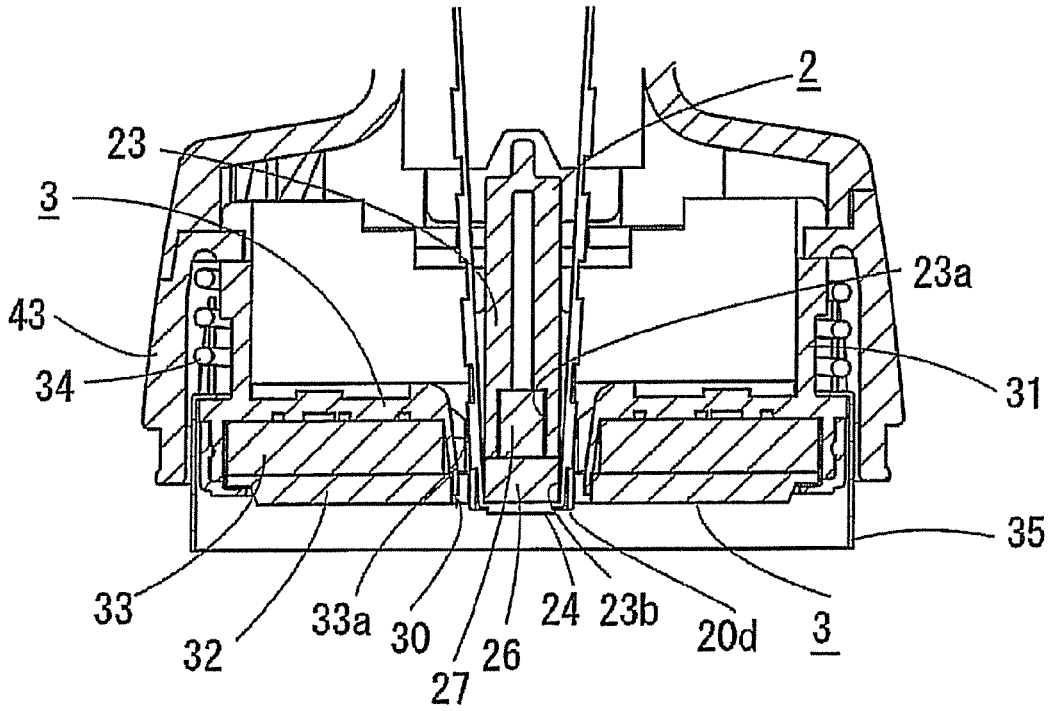
FIG. 15 is an explanatory diagram showing a non-stamping condition.
Figure 16:
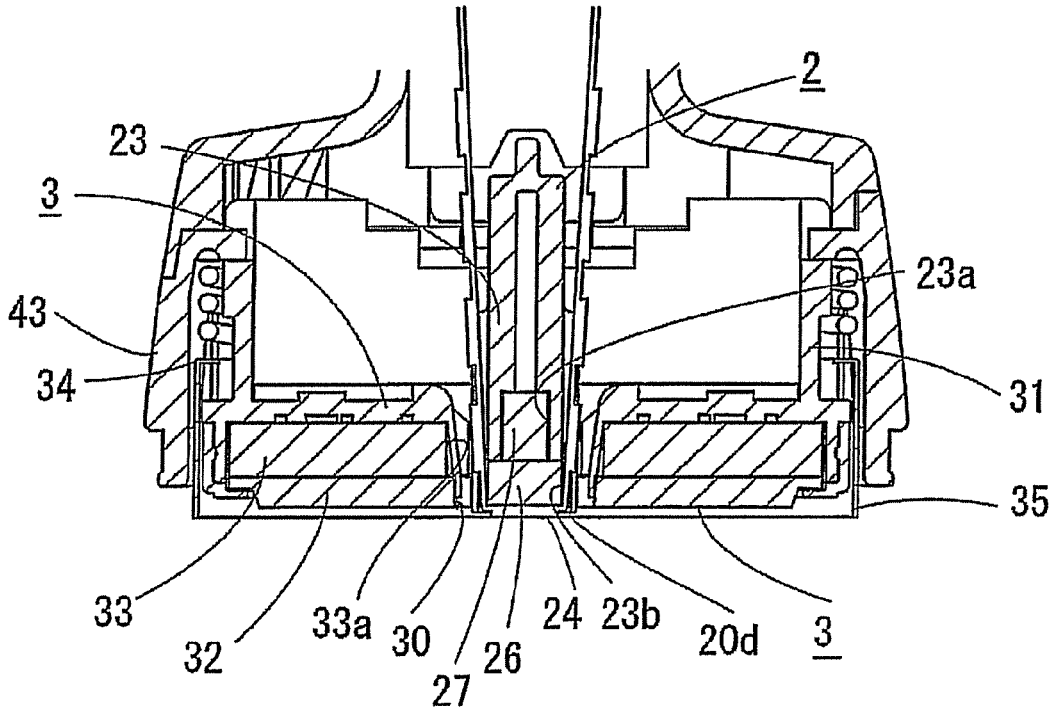
FIG. 16 is an explanatory diagram showing a stamping condition by the rotary stamp.
Figure 17:
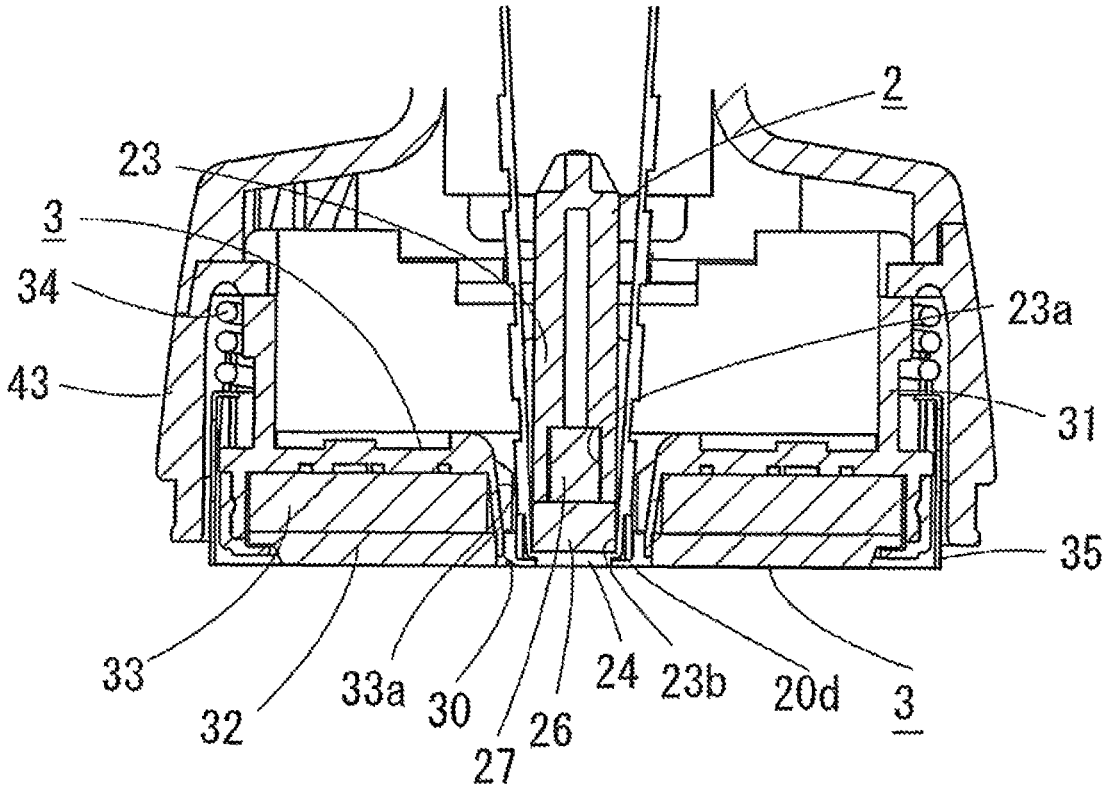
FIG. 17 is an explanatory diagram showing a stamping condition by the mater stamp.

As shown in FIGS. 10-13, a porous fixed print base 32 of the master stamp 3 including the oblong hole 30 is a circular structure mounted in the concave part of the cylindrical master stamp frame 31 in which an elongated square hole 31*a* is formed in the center part thereof. There are provided a circular ink absorbing body 33 in which an elongated square hole 32*a* is formed as shown in FIG. 13 while an elongated square hole 33*a* is formed in its rear face thereof as shown in FIG. 12 and a cylindrical metallic slide 35 for print face protection having an inside jaw at its upper edge as shown in FIG. 11, the cylindrical metallic slide being mounted to the master stamp frame 31 by being urged by the coil spring 34.

In the grip case 4, stepped parts 41 are formed in the front and rear faces of the intermediate part of a gripping cylindrical part 40 for the rotator 22 of the rotary stamp 2 to be operable from outside and the rotators 22 are exposed through slits 42 and a cylindrical sheath 43 is extended on the bottom part of this grip case 4 while the master stamp 3 is incorporated within the sheath 43. In the meantime addition, reference numeral 44 denotes an indication label attached to the top plate of the grip case 4.

Reference numeral 6 denotes a clicker which prevents each rotator 22 exposed outside from being moved unexpectedly when it comes into a contact with other object and this clicker 6 is integrated with the rotary stamp frame 20 by engaging the engagement piece 60 with the engaging hole 23*c* in the rotary stamp frame 20 which supports each rotator while rectangular frame-like engagement spring pieces 61 which engage the notch part 22*a* for slip prevention, formed on the outer peripheral face of each rotator 22 are provided perpendicularly on the right and left sides. An engaging piece 62 for receiving the coil spring as the spring member is formed on the top face of the clicker 6.

When using such a rotary stamp, first, the rotator 22 exposed through the slit 42 formed in the stepped part 41 of the gripping cylindrical part 40 of the grip case 4 is rotated appropriately so as to set the print face to a desired content. At this time, the notch part 22*a* of the rotator 22 is always in engagement with the engagement spring piece 60 of the clicker 6, thereby blocking the rotation of the rotator 22 and thus, the endless print belt is not rotated unless the rotator 22 is operated, and thus, it is not changed unexpectedly when it comes in contact with other object.

When the user operates the rotator 22, a unique operating sound is generated because the engagement spring piece 60 of the clicker 6 in engagement with the notch part 22*a* of the rotator 22 comes into engagement with dents of the notch part 22*a* and user can obtain a secure operation feeling by a feeling given each time when the rear faces of the grooves 25 in the endless print belt 24 are placed on the corners of the bridge part 23. Further, after the operation of changing the print face is completed, the rotator is blocked from being rotated by the clicker 6 securely, and thus, the print face is not changed carelessly.

After the print face is changed by the above-described simple operation, the stamping action by gripping the gripping cylindrical part 40 of the grip case 4 is the same as conventional ways. However, the rotary stamp with the master stamp of the present invention is a thin melt-processed laminated belt constituted of the print section 52 in which the superficial layer of the laminated belt base composed of the thermoplastic resin belt foundation 24*a* having an infinite number of continuous pores as a front layer and the ink circulation reinforced rear fabric 24*b* as a rear layer is kept in the porous state, and the melt-processed, non-porous surface which surrounds that print section. Further, the width in the back and forth direction of the oblong hole 30 is comprised of total lateral width of each endless print belt 24 and width in the back and forth direction of the bridge part 23 plus gaps in front and back for each print face to pass through, so that when the endless print belt 24 is rotated, the print section 52 of the endless print belt 24 passing along the bridge part 23 in a state in which it is exposed through the oblong hole 30 does not make contact with the front/rear edges of the oblong hole 30. Consequently, the reduction of an effective usage area of the master stamp 3 is slight with no unnecessary gap is generated between the porous fixed print base 32 of the master stamp 3 and the rotary stamp 2 while the preferable design performance is secured.

Additionally, even if the endless print belts 24 on both sides are inclined in structure, the print face is kept substantially horizontal following the receiving plane of the bridge part 23 so that a print image without any distortion is obtained, because the thin melt-processed laminated belt is used as described previously.

What is claimed is:

1. A rotary stamp with master stamp comprising:

a rotary stamp in which an endless print belt is stretched between a shaft part of a rotator supported rotatably by a shaft provided on a rotary stamp frame and a bridge part provided on the rotary stamp frame; and a master stamp having a porous fixed print base containing an oblong hole which exposes a desired print section from a plurality of print sections provided along an outwardly facing belt surface of the endless belt of the rotary stamp, with the rotary stamp and the master stamp being built in a grip case, wherein the endless print belt of the rotary stamp is a thin melt-processed laminated belt whereby the print sections are kept in a porous state and a space part between the print sections is treated into a non-porous state, the print section and the space part being created as a result of melt-processing a superficial layer of the space part, whereby the endless laminated belt base is composed of a thermoplastic resin base belt foundation having an infinite number of continuous pores as a front layer and an ink circulation reinforced rear fabric as a rear layer, the oblong hole in the master stamp has a width in the front-forth direction which allows the endless print belt to be rotated such that the outwardly facing belt surface of the endless belt does not make contact with hole edges in the front and back of the oblong hole when the belt is rotated along the bridge part with the print section being exposed through the oblong hole, and a changing of the print section of the rotary stamp that is exposed through the oblong hole is only enabled by a rotating operation of a rotator exposed outside of the grip case.

2. The rotary stamp with master stamp according to claim 1, wherein the rotary stamp built in the grip case is pushed by a spring member so that a desired print section of the endless print belt is always exposed through the oblong hole while being projected slightly from the master stamp surface of the master stamp when the stamp is pressed, primary stamping by the print face of the rotary stamp is carried out while the rotary stamp is pushed up against the force of the spring member such that the print face of the rotary stamp is flush with the master stamp surface, so as to execute a secondary stamping by the master print surface.

3. The rotary stamp with master stamp according to claim 1, wherein a groove in width direction is formed in the space part formed in the non-porous state between the print sections of the endless print belt.

4. The rotary stamp with master stamp according to claim 3, wherein at both ends of the formed groove enclosing bund parts are left.

5. The rotary stamp with master stamp according to claim 1, wherein pyramidal projections for engaging the endless print belt are disposed on an outer peripheral face of a shaft part of the rotator in a staggered fashion.

6. The rotary stamp with master stamp according to claim 1, wherein a control plate made of synthetic resin for smoothing a rotation of the rotator is built on a shaft stretched in the rotary stamp frame along the inner side of the rotator.

7. The rotary stamp with master stamp according to claim 1, wherein a notch part is formed in an outer peripheral face of the rotation operating part of the rotator.

8. The rotary stamp with master stamp according to claim 7, wherein a clicker is assembled in a rotary stamp frame, such that the top face thereof is pushed by a spring member, with an engagement spring piece of a leg end engaged with an engagement hole provided in the top part of a rotary stamp frame, and the clicker is provided with a rectangular frame-like engagement spring piece which is always engaged with a notch part in the outer periphery of a rotator, while when the rotator is rotated, the engagement spring piece engages the indentation of the notch part so as to produce a unique operating sound.

9. The rotary stamp with master stamp according to claim 1, further comprising a first ink absorbing body positioned immediately adjacent to the ink circulation rear layer of the endless belt, and wherein the first ink absorbing body supplies ink to the ink circulation rear layer of the endless belt.

10. The rotary stamp with master stamp according to claim 9, wherein the thermoplastic resin base belt foundation and the first ink absorbing body are formed of a porous material, whereby the porous material used in the formation of both the resin base belt foundation and the first ink absorbing body is the same porous material.

11. The rotary stamp with master stamp according to claim 1, wherein the ink circulation rear layer forms an inwardly facing backside surface of the endless belt, and wherein the thickness of the endless belt is less than 2.0 μm.

* * * * *